United States Patent [19]

Klein et al.

[11] 3,958,194

[45] May 18, 1976

[54] FREQUENCY-SENSITIVE ATTENUATOR

[75] Inventors: Gerald I. Klein, Baltimore; Thomas E. Steigerwald, Simpsonville, both of Md.

[73] Assignee: The United States of America as represented by the Secretary of the Navy, Washington, D.C.

[22] Filed: Jan. 3, 1975

[21] Appl. No.: 538,634

[52] U.S. Cl. ..... 333/81 B; 333/33; 333/73 W

[51] Int. Cl.[2] ..... H01P 1/22; H01P 1/20

[58] Field of Search ..... 333/24 R, 73 W, 22 R, 333/81 B, 9, 35, 33, 11

[56] References Cited

UNITED STATES PATENTS

| | | | |
|---|---|---|---|
| 2,766,431 | 10/1956 | Barker, Jr. | 333/9 |
| 3,058,072 | 10/1962 | Rizzi et al. | 333/73 W |
| 3,493,898 | 2/1970 | Ward | 333/11 |
| 3,639,862 | 2/1972 | Craven et al. | 333/73 W |

*Primary Examiner*—Paul L. Gensler

*Attorney, Agent, or Firm*—R. Sciascia; R. Beers; S. Sheinbein

[57] ABSTRACT

A miniature waveguide attenuator which may be used in a dominant-mode ($TE_{10}$) waveguide to maintain a low VSWR over a 20% frequency band comprising a short section of waveguide with an E- or an H-plane tee whose width is selected to set the cutoff frequency of the branch line of the tee at the design frequency $F_o$. The branch line of the tee is terminated in a lossy material followed by a short circuit for absorbing energy propagating down the waveguide at frequencies higher than the design frequency in accordance with a controlled attenuation characteristic.

6 Claims, 5 Drawing Figures

FREQUENCY-SENSITIVE ATTENUATOR

BACKGROUND OF THE INVENTION

1. Field of Invention

The present invention relates generally to high-frequency waveguides and in particular to a frequency-sensitive attenuator for the dominant mode of a waveguide.

2. Discussion of the Prior Art

Practical waveguides are frequently designed so that they propagate electro-magnetic energy only in the dominant mode ($TE_{10}$). These waveguides must be restricted in physical size in order to effect this mode exclusively. Accordingly, there are size constraints on the circuit elements that are utilized with dominant-mode waveguides.

The present invention deals specifically with waveguide frequency attenuators. It is frequently necessary to attenuate energy propagating through a waveguide in accordance with a controlled, frequency-attenuation characteristic. The prior art devices used to effect such controlled attenuation are large and bulky. For example, it is well known that Gunn Diode oscillators are subject to frequency jumping when subjected to high VSWR load reflections at frequencies associated with spurious frequency operation (usually 5–20 percent above the design frequency of the system). Since the loads in a microwave system are usually fairly well matched to the waveguide and oscillator at the design frequency, the dominant portion of the VSWR load reflections occur at 5–20 percent of the design frequency. A typical load VSWR curve for a center design frequency, $F_o$, is shown in FIG. 1. Thus, when employing such an oscillator to drive a tuned load, a broadband isolator is usually required to keep the effective load VSWR below 3:1 over a 20 percent or more frequency band and thus stabilize the system. Such isolators are expensive, sensitive to external magnetic fields, and often take more room than is available in small, microwave packages.

The present invention utilizes the cutoff frequency parameter of a dominant-mode waveguide to produce a miniature, controllable, frequency attenuator. It is well known that each mode (the distinctive, spatial, field configuration of the electromagnetic energy) of transmission in a waveguide will carry energy through the waveguide only if the frequency of the energy is above a certain limiting or cutoff value for that particular mode. This value depends upon the size and configuration of the line as well as upon the particular mode of transmission. If these modes are excited in a waveguide at frequencies below their cutoff frequencies, they will carry no real energy down the waveguide, and the electric and magnetic field associated with any given mode will diminish exponentially with distance from the point of excitation.

In a rectangular waveguide, for any particular mode of transmission, the cutoff wavelength $\lambda_c$ is given in terms of the guide dimensions $a$ and $b$ by $$\lambda c = \frac{2}{\sqrt{\left(\frac{m}{a}\right)^2 + \left(\frac{n}{b}\right)^2}} \qquad 1$$

The dimensions $a$ and $b$ are shown in the cross-sectional view of the rectangular waveguide of FIG. 2. The terms $m$ and $n$ in the formula are the subscripts denoting the particular mode under consideration. $m$ indicates the number of half-wave lengths in the transverse field intensity along the b dimension of the waveguide while n denotes the number of half-wave lengths in the a dimension. This formula holds for either the TE or TM modes of transmission.

The energy configuration for the dominant-mode of a rectangular waveguide ($TE_{10}$), since it is the mode of primary interest, is shown in FIG. 2. The curve 30 represents this energy configuration.

SUMMARY OF THE INVENTION

Briefly, the present invention is a dominant-mode, waveguide, frequency attenuator which has a controllable attenuation vs. frequency characteristic. The device comprises a short section of waveguide with an E or an H-plane tee whose width is selected to set the cutoff frequency of the tee branch line at the design frequency. This tee branch line is terminated in a lossy material load. Thus, the higher the frequency above the design frequency, the more easily it propagates in this branch line, and thus the greater the attenuation.

OBJECTS OF THE INVENTION

An object of the present invention is to attenuate frequencies above a design frequency in a waveguide in a controllable manner.

A further object of the present invention is to replace the present broadband isolators in waveguide, Gunn-Diode-oscillator systems with a small, low cost component.

A still further object is to attenuate energy in a waveguide in a controllable manner with a small, low cost device.

DETAILED DESCRIPTION OF THE INVENTION

Figure 3B:
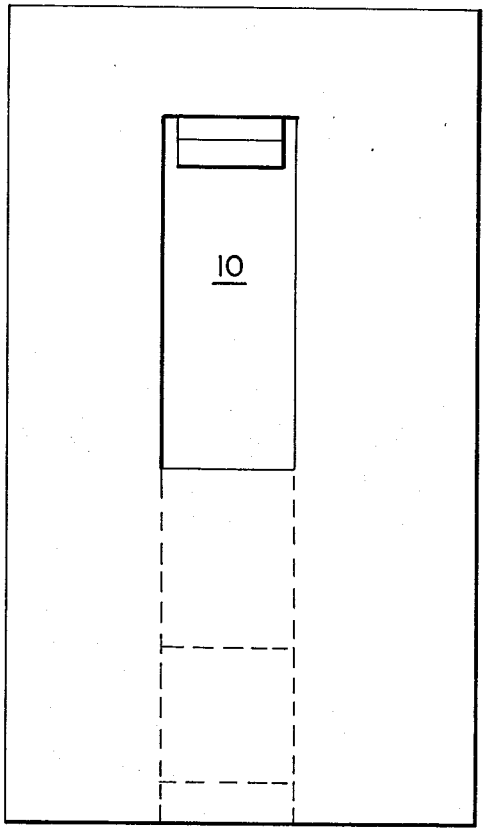
FIG. 3*b* is a front view of the embodiment shown in FIG. 3*a*.
Figure 3A:
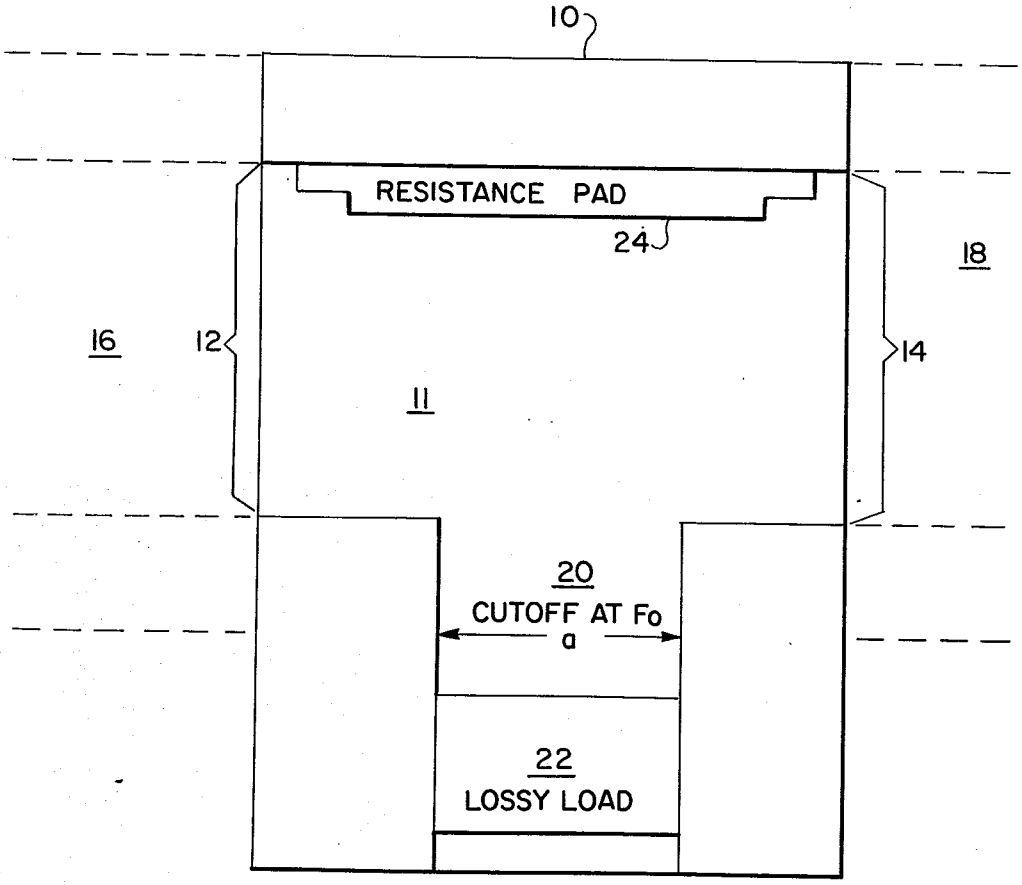
FIG. 3*a* is a top, cross-sectional view of an embodiment of the present invention.

FIG. 3*a* and 3*b* show the short length of waveguide with the tee-section 10 that comprises the present invention. Although an H-plane tee is shown in the figure, an E-plane tee could easily be substituted in its place. From the top, cross-sectional view of FIG. 3*a* it can be seen that the width of the main cavity 11 of the tee may be set to the standard waveguide width for a dominant-mode waveguide. Thus the section may be easily connected into a waveguide line by merely connecting each of the ends 12 and 14 to the ends of two waveguide sections 16 and 18 (shown as the dashed line structure in FIG. 3*a*). Another frequently-used method of inserting a circuit component into a waveguide structure comprises merely cutting a hole in the top of a dominant-mode waveguide and dropping the tee device into this hole so that energy propagating down the waveguide passes through the straight section of the tee attenuator.

The E- or H-plane tee 10 is designed to have a branch line 20 with a cutoff frequency set at the design frequency $F_o$. This is accomplished by determining from equation 1 what the width dimension *a* should be for a cutoff frequency equal to the design frequency $F_o$ and setting the width accordingly. (Since this is a dominant-mode system, $m=1$ and $n=0$). Thus, this branch line 20 propagates all frequencies above the cutoff or design frequency according to the curve shown in FIG. 4.

The branch line 20 is terminated in a load 22 comprising a block of lossy material followed by a short circuit. The lossy load 22 may be positioned in any manner or set in any configuration so long as the dominant-mode energy propagating in the branch line 20 is absorbed. A typical material that could be used for the lossy material 22 is Emerson and Cumming MF 114.

Adjustment of the distance from the main waveguide cavity 11 to the lossy material plug 22 may be employed to tune the junction and provide the desired slope of attenuation with frequency. (Shortening the distance steepens the slope of the curve of FIG. 4 while increasing the distance to the lossy plug 22 lessens the slope).

A resistance pad 24 may be attached to the top of the main, waveguide cavity 11 to reduce the VSWR of the system even further. Typically, a 1 db pad comprising a notched or unnotched resistance card may be used. Such cards generally comprise a metal film evaporated on to a plastic sheet. This pad 24 absorbs any energy reflections coming from the branch 20 of the tee.

The insertion of the resistance pad 24 into the waveguide line creates an impedance discontinuity for the energy propagating down the waveguide. In order to prevent this impedance discontinuity from reflecting energy propagating down the waveguide the resistance card 24 may be notched (as shown in FIG. 3*a*) or tapered.

Although the overall VSWR of the device is reduced by the addition of this 1 db. pad in the main guide, this reduction is effected at the expense of an increased insertion loss.

Figure 1:
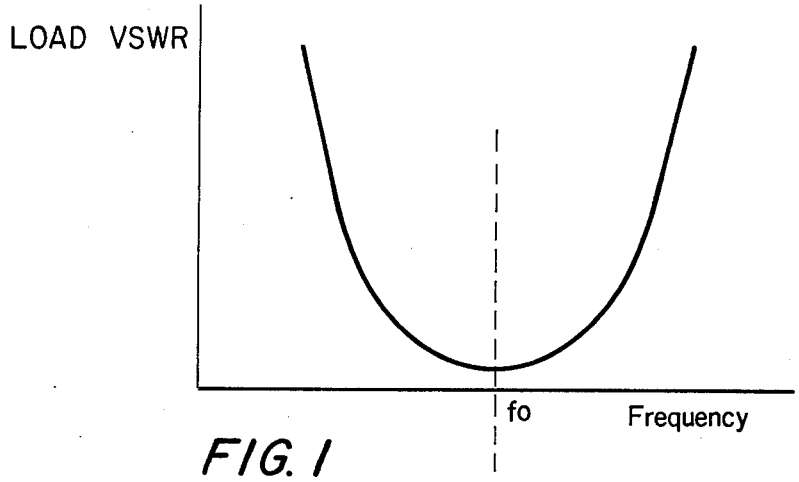
FIG. 1 is a graph of the Load VSWR vs. frequency for a loaded waveguide.
Figure 2:
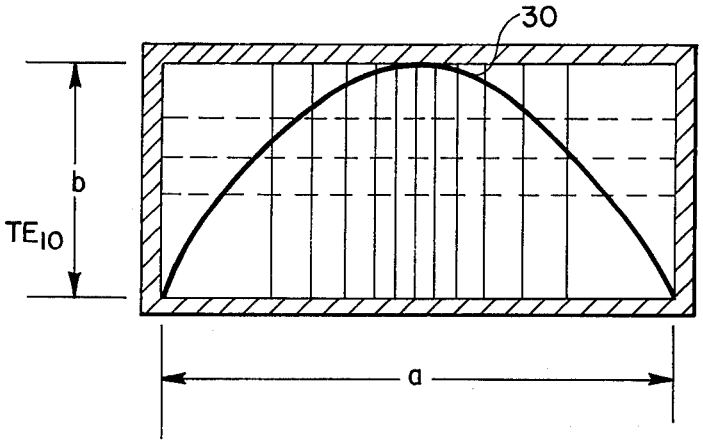
FIG. 2 is a front, cross-sectional view of a rectangular waveguide with the energy distribution of the dominant mode shown.
Figure 4:
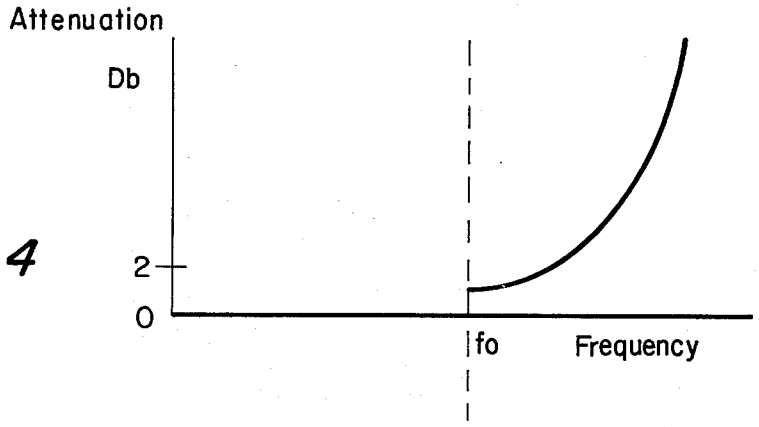
FIG. 4 is a graph of attenuation in db. vs. frequency for the attenuation device of the present invention.

Thus, in summary, a small-size, low-cost, in-line, waveguide attenuator has been developed which is compatible with most, dominant-mode waveguides. The attenuator provides an attenuation characteristic which rises from about 2 db. at the design frequency $F_o$ to about 5.5 db. at a 15 percent higher frequency while maintaining an input VSWR of 1.5 (this characteristic is shown in FIG. 4).

Obviously, many modifications and variations of the present invention are possible in light of the above teachings. It is therefore to be understood that, within the scope of the appended claims, the invention may be practiced otherwise than as specifically described.

What is claimed is:

1. A frequency-sensitive attenuator for providing a controlled attenuation characteristic in a dominant-mode waveguide comprising:

a waveguide tee having a branch line, said branch line having its width set so that the cutoff frequency of said branch line is at the design frequency, said dominant-mode waveguide connected to opposite ends of the straight section of said waveguide tee for propagating energy to a load through said waveguide tee at said design frequency; and lossy means terminating said branch line so that any energy propagating down said branch line at frequencies higher than said design frequency are absorbed according to a controlled attenuation characteristic, said characteristic obtained by adjusting the distance of said lossy means from the entrance of said branch line.

2. A frequency-sensitive attenuator as defined by claim 1, wherein said lossy means comprises a block of lossy material followed by an electrical, short-circuit.

3. A frequency-sensitive attenuator as defined by claim 1, wherein said straight section of said waveguide tee comprises a rectangular waveguide.

4. A frequency-sensitive attenuator as defined by claim 1, further comprising:

a flat resistance-pad for absorbing any energy reflected from said branch line and thus further reducing the VSWR of the system, said pad being attached to the inside of the wall of said tee opposite to the entrance to said branch line.

5. A frequency-sensitive attenuator as defined by claim 4, wherein said resistance-pad is notched at its ends to provide a smoother impedance transition for any electro magnetic energy propagating through said straight section of said waveguide tee.

6. A method for adjusting the slope of the frequency-attenuation curve in a dominant-mode waveguide with a waveguide tee-section set therein having a branch line with its width set so that the cutoff frequency of said branch line is at the design frequency at which energy is to be propagated through said dominant-mode waveguide, said method comprising the steps of:

inserting a lossy plug in said branch line so that a portion of the energy propagating down said branch line at frequencies higher than said design frequency is absorbed;

propagating energy at said design frequency through said dominant-mode waveguide; and adjusting the distance of said lossy plug in said branch line from the main waveguide cavity of said dominant-mode waveguide to obtain a desired attenuation characteristic.

* * * * *